US005824167A

United States Patent [19]

Ishikawa et al.

[11] Patent Number: 5,824,167

[45] Date of Patent: Oct. 20, 1998

[54] BERYLLIUM-COPPER ALLOY EXCELLENT IN STRENGTH, WORKABILITY AND HEAT RESISTANCE AND METHOD FOR PRODUCING THE SAME

[75] Inventors: Shuhei Ishikawa; Hiroyuki Hiramitsu; Yoshihisa Ishiguro; Kazumasa Yashiro, all of Nagoya, Japan

[73] Assignee: NGK Insulators, Ltd., Japan

[21] Appl. No.: 513,887

[22] PCT Filed: Dec. 27, 1994

[86] PCT No.: PCT/JP94/02253

§ 371 Date: Oct. 30, 1995

§ 102(e) Date: Oct. 30, 1995

[87] PCT Pub. No.: WO95/18873

PCT Pub. Date: Jul. 13, 1995

[30] Foreign Application Priority Data

Jan. 6, 1994 [JP] Japan ..... 6-022997
Nov. 7, 1994 [JP] Japan ..... 6-272464

[51] Int. Cl.[6] ..... C22C 9/06

[52] U.S. Cl. ..... 148/435; 148/436; 148/682; 148/685

[58] Field of Search ..... 148/682, 685, 148/432, 435, 436; 420/494, 485, 486, 489, 490

[56] References Cited

U.S. PATENT DOCUMENTS 2,136,212 11/1938 Hensel et al. ..... 75/159
2,400,566 5/1946 Misfeldt ..... 75/159
4,792,365 12/1988 Matsui et al. ..... 148/685

FOREIGN PATENT DOCUMENTS 0282204 9/1988 European Pat. Off. .
47-47207 11/1972 Japan .
50-32019 3/1975 Japan .
59-59851 4/1984 Japan .
62-199742 9/1987 Japan .
63-125648 5/1988 Japan .
3-294462 12/1991 Japan .
4-221031 8/1992 Japan .
4-268055 9/1992 Japan .
600303 4/1948 United Kingdom .

*Primary Examiner*—Sikyin Ip

[57] ABSTRACT

In the present invention, in order to minimize the amount of deformation due to heat treatment, the content of Be is lowered than the conventional ones, and the decrease in strength accompanied by decreasing Be, is compensated by dissolving strengthening of Si and Al, and precipitation strengthening of intermetallic compounds NiBe and CoBe. Further, by precipitating such intermetallic compounds, workability and heat resistance are also improved simultaneously and aging treatment conditions are also made flexible. Thus, according to the present invention, a beryllium-copper alloy having excellent strength, workability and heat resistance, can be provided economically, and particularly as for aging materials, users' burden can be markedly decreased.

1 Claim, 1 Drawing Sheet

BERYLLIUM-COPPER ALLOY EXCELLENT IN STRENGTH, WORKABILITY AND HEAT RESISTANCE AND METHOD FOR PRODUCING THE SAME

TECHNICAL FIELD

The present invention relates to beryllium-copper alloys used as electrically conductive spring materials for lead frames, terminals, connectors, relays, switches, jacks and the like, of which such properties as strength, workability and stress-relaxation are important, and a method for producing the same.

BACKGROUND ART

Beryllium-copper alloys containing 0.2 to 0.3% by weight of Be in copper have been known heretofore as electrically conductive spring materials and disclosed in Japanese Patent Examined Publication No. 4-53936 by the present applicant. As such beryllium-copper alloys, there are aging materials of which an aging treatment is performed by users, and mill-hardened materials of which aging treatment have been applied before shipping.

Recently, due to an enhanced miniaturization of electronic parts, higher strength is required also for beryllium-copper alloys. The materials to be obtained are disclosed in JIS C 1720 (Be 1.8 to 2.0% by weight).

However, in these aging materials of such beryllium-copper alloys, there have been disadvantages that deformation is likely to occur during aging treatment and also setting up of treating conditions is difficult due to narrow tolerance of aging treatment conditions. Therefore, there has been a problem that it is not necessarily easy to attain the desired characteristics by aging treatment at the user's side. Also, in the conventional mill-hardened material of beryllium-copper alloys, there have been problems that a sufficient workability cannot be obtained and, in particular, bending workability is poor in a direction perpendicular to the direction of rolling. Further, as to heat resistance that can be regarded as an index of long-term reliability, there has been a problem that stress-relaxation ratio is large, Incidentally, the stress-relaxation ratio is a value indicating reduction Of spring properties for a long period of time and the measuring method thereof is regulated in EMAS (Japan Electronic Manufacturers Association Standard)-3003 as "Testing Method of Stress-Relaxation by Bending of Spring Materials". According to this standard, the stress-relaxation is defined as a phenomenon that the stress generated in materials under a constant strain decreases slowly with a lapse of time.

DISCLOSURE OF THE INVENTION

The present invention has been developed to address above-mentioned conventional problems. It is an object of the invention to provide a beryllium-copper alloy which is excellent in strength as a matter of course, which can be used as an aging material having a wide tolerance of the aging treatment conditions, i.e., flexible treatment conditions so as to reduce the burden at the user end by making deformation at the aging treatment difficult, and which can be also used as a mill-hardened material having excellent workability and heat resistance. It is a further object of the invention to provide an advantageous method for producing the same.

According to the present invention, there is provided a beryllium-copper alloy excellent in strength, workability and heat resistance, having a composition containing Be: 0.5 to 1.5% by weight, at least one member selected from the group of Ni and Co: 0.3 to 1.5% by weight, at least one member selected from the group of Si and Al; 0.5 to 2.5% by weight, and the balance being substantially Cu, said alloy containing as an intermetallic compound NiBe or/and CoBe in the range of 0.20 to 0.90% by weight, and at least 45% thereof being present as fine particles having a diameter of 0.1 $\mu$m or less.

Also, the present invention provides a method for producing a beryllium-copper alloy which is excellent in strength, workability and heat resistance, and which comprises subjecting to hot working and subsequent cold working a cast material having a composition containing Be: 0.5 to 1.5% by weight, at least one member selected from the group of Ni and Co; 0.3 to 1.5% by weight, at least one member selected from the group of Si and Al; 0.5 to 2.5% by weight, and the balance being substantially Cu, subsequently subjecting the material to a solution treatment at a temperature of 800° C. or higher, cooling at a rate of 20° C./s or more between the temperature range of at least 800° C. to 600° C., subsequently subjecting the material to finishing working of 5 to 40%, and then applying aging treatment to the material at a temperature of 300° to 460° C.

In the present invention, strength, workability and heat resistance to be attained as target are as follows.

First, as to strength, it should satisfy a tensile strength of 84 to 115 kgf/mm$^2$.

As for workability, at the tensile strength of 84 to 97 kgf/mm$^2$, when bending work is performed with a R/t ratio (R: bending radius, t: plate thickness) of 1.0, it should be possible to perform good work in any direction with respect to the direction of rolling.

Further, as to heat resistance, that is, a heat treatment deformation amount, a deformed amount (change in warpage amount) of a material before and after aging treatment of a material having a size of 20 mm×20 mm, and a plate thickness of 0.3 mm should be 10 $\mu$m or less.

Furthermore, flexibility of the heat treatment conditions in accordance with the present invention should be such that a fluctuation of a tensile strength is within the range of ±8 kgf/mm$^2$ even when optional aging conditions are selected.

In the following, the present invention will be explained specifically.

The first characteristic feature of the beryllium-copper alloy of the present invention resides in that, in order to reduce deformation due to heat treatment, the content of Be is made 1.5% by weight or less which is markedly reduced as compared with the conventional beryllium-copper alloy. Nevertheless, when the content of Be is less than 0.5% by weight, strength is insufficient since a strengthening mechanism is not effective. Accordingly, in the present invention, the content of Be is limited in the range of 0.5 to 1.5% by weight. Incidentally, a more preferred range of Be is 0.7 to 1.3% by weight, and further preferred range is 0.9 to 1.1% by weight.

The second characteristic feature of the beryllium-copper alloy of the present invention resides in that lowering in strength accompanied by decreasing the content of Be as mentioned above is compensated by composite addition of Si, Al and Ni, Co.

First, explanation will be made of Si and Al. These are each dissolved in the Cu mother phase as a solid solution and contribute to improvement in strength by solid solution strengthening mechanism. However, when their content is less than 0.5% by weight, strength and workability are insufficient, while when the content exceeds 2.5% by weight, conductivity, rolling workability and soldering property are lowered and also deformation due to heat treatment is promoted. Accordingly, Al and Si are to be contained in the range of 0.5 to 2.5% by weight in either case of single use or in combination. A more preferred range is 1.0 to 2.5% by weight, and a further preferred range is 1.5 to 2.5% by weight.

Next, explanation will be made of Ni and Co. These precipitate in the Cu mother phases as an intermetallic compound such as NiBe or CoBe, etc., and contribute to improvement in strength due to their precipitation strengthening mechanisms. And yet, by precipitation of such an intermetallic compounds heat resistance, etc. are also improved.

When precipitation strengthening is intended by an intermetallic compound mainly comprising the above-mentioned NiBe or CoBe, if the content of Ni or/and Co is less than 0.3% by weight, not only is strength lowered but also grain size becomes coarse whereby workability becomes poor. On the other hand, when the content of Ni or/and Co exceeds 1.5% by weight, the amount of the intermetallic compound formed between Be, Si, Al, etc. increases whereby bending workability becomes poor. Accordingly, Ni and Co should be contained in the range of 0.3 to 1.5% by weight in either case, whether used alone or in combination. A more preferred range is 0.3 to 1.1% by weight, and a further preferred range is 0.3 to 0.7% by weight.

Also, it is necessary that the amount of NiBe, CoBe intermetallic compounds to be precipitated, is in the range of 0.20 to 0.90% by weight. The reason is that when the content is less than 0.20% by weight, sufficient strength cannot be obtained, while when it exceeds 0.90% by weight, bending workability is markedly lowered and heat resistance is also lowered. Accordingly, a more preferred amount of the intermetallic compound mainly comprising NiBe and CoBe is in the range of 0.20 to 0.60% by weight when it is used as a mill-hardened material, whereas it is in the range of 0.30 to 0.75% by weight when it is provided as an aging material.

Further, in the NiBe and CoBe intermetallic compounds, a size of the precipitate, i.e., a grain size is important. The reason is that even when the content of the intermetallic compounds satifies the above-mentioned preferred range, if the ratio of grains exceeding 0.1 $\mu$m is large, cracks will likely be generated upon working based on such coarse grains. Thus, in the present invention, as for the intermetallic compound, at least 45% of the compound should be contained as fine particles with a diameter of 0.1 $\mu$m or less.

As stated above, in the present invention, in order to make compatible all of strength, bending workability and heat resistance, etc., characteristics such as strength and bending workability, etc. are improved by Be, Si and Al. Also, in the present invention, in order to suppress deformation in the shape of the material during aging treatment, an amount of Be is decreased. As for lowering in strength accompanied by decrease in Be, properties are improved by precipitation strengthening of the intermetallic compounds mainly comprising NiBe and CoBe, and solid solution strengthening owing to Si, Al and the like.

Incidentally, among the intermetallic compounds mainly comprising NiBe and CoBe, an intermetallic compound such as $NiAl_3$, NiSi, etc. are also included in a little amount.

Also, in addition to the above-mentioned components, Fe, Ti, Cr, etc., may be added as a sub-component in the range of 0.05 to 0.5% by weight. These are components each of which contributes to improve strength, and particularly, Fe and Si are components which also contribute to improve workability.

The third characteristic feature of the beryllium-copper alloy of the present invention resides in that heat treatment conditions are made flexible. The reason is that the precipitation temperature of NiBe or CoBe has an extremely wide temperature range of 300° to 460° C., and the treatment time also has an extremely wide range of 15 minutes to 6 hours. And yet, even when in such wide treatment conditions, the variation range of tensile strength can be made within the range of ±8 kgf/mm$^2$.

As a result, the aging treatment at the user side becomes markedly easy as compared with prior art and the user's burden can be remarkably reduced.

Next, preferred preparation conditions of the present invention will be explained.

To the cast piece prepared by the above-mentioned preferred composition range of components is subjected hot working and cool working. The alloy of the present invention has essentially good hot workability and cool workability as long as it satisfies the above-mentioned composition range of the components.

Then, a solution treatment is carried out in order that elements forming intermetallic compounds such as NiBe, CoBe, etc. are sufficiently dissolved in the mother phase as a solid solution. In this solution treatment, if the treatment temperature is less than 880° C., dissolution of elements forming intermetallic compounds into the alloy becomes insufficient and bending workability of the product becomes poor, so that it is necessary to set the solution treatment temperature at 880° C. or higher.

After the above solution treatment, the alloy is cooled to normal temperature. In the present invention, with regard to such a cooling treatment, it is important to carry out the cooling at a rate of 20° C./s or more, for at least the temperature range of 800° C. to 600° C. The reason is that the temperature range of 800° to 600° C. is a range in which intermetallic compounds such as NiBe, CoBe, etc., are likely precipitated with a coarse grain. Thus, if the cooling rate is slower than 20° C./s, most part of the intermetallic compounds precipitates as coarse grains, and as a result, precipitation of fine grains with a sufficient amount in the subsequent aging treatment cannot be expected. Such coarse grains make workability poor. Accordingly, in the present invention, after the solution treatment, the cooling should be carried out at a rate of 20° C./s or more for at least the temperature range of 800° to 600° C. More preferably, it is 40° C./s or more.

Incidentally, the above-mentioned quenching treatment after the solution treatment is not limited only to the temperature range of 800° to 600° C., but it is needless to say that the same quenching treatment thereafter, for example, until at room temperature, is advantageous for maintaining a sufficient amount of solid solution of the elements for forming an intermetallic compound.

Here, as for cooling means, any means are effective as long as the above-mentioned cooling rate can be ensured, and it is not particularly limited. Thus, water cooling, mist cooling, gas cooling, etc. are particularly advantageously adopted.

Then, finishing work is carried out to finish the alloy to a shape of a product. At this time, if the working ratio is less than 5%, sufficient strength cannot be obtained, while if it exceeds 40%, bending workability deteriorates so that the working ratio is limited to the range of 5 to 40%. More preferred working ratio is 10 to 20%.

Subsequently, an aging treatment is carried out to precipitate a desired intermetallic compound.

Here, when the aging temperature is less than 300° C., sufficient strength cannot be obtained or, even when obtained, bending workability deteriorates. On the other hand, if it exceeds 460° C., bending workability also deteriorates. Thus, it is necessary to set the aging temperature in a range of 300° to 460° C. Also, the aging time can be selected from a wide range of 15 min to 6 hours. More preferred aging treatment conditions are the temperature of 320° to 380° C. and the time of 20 min to 3 hours, and further preferred treatment conditions are the temperature of 330° to 360° C. and the time of 1 to 3 hours.

Thus, it is possible to obtain a beryllium-copper alloy which deforms little during heat treatment at an aging treatment, has flexible aging treatment conditions, and yet has excellent strength, bending workability and heat resistance.

BEST MODE FOR CARRYING OUT THE INVENTION

Example 1

Figure 1:
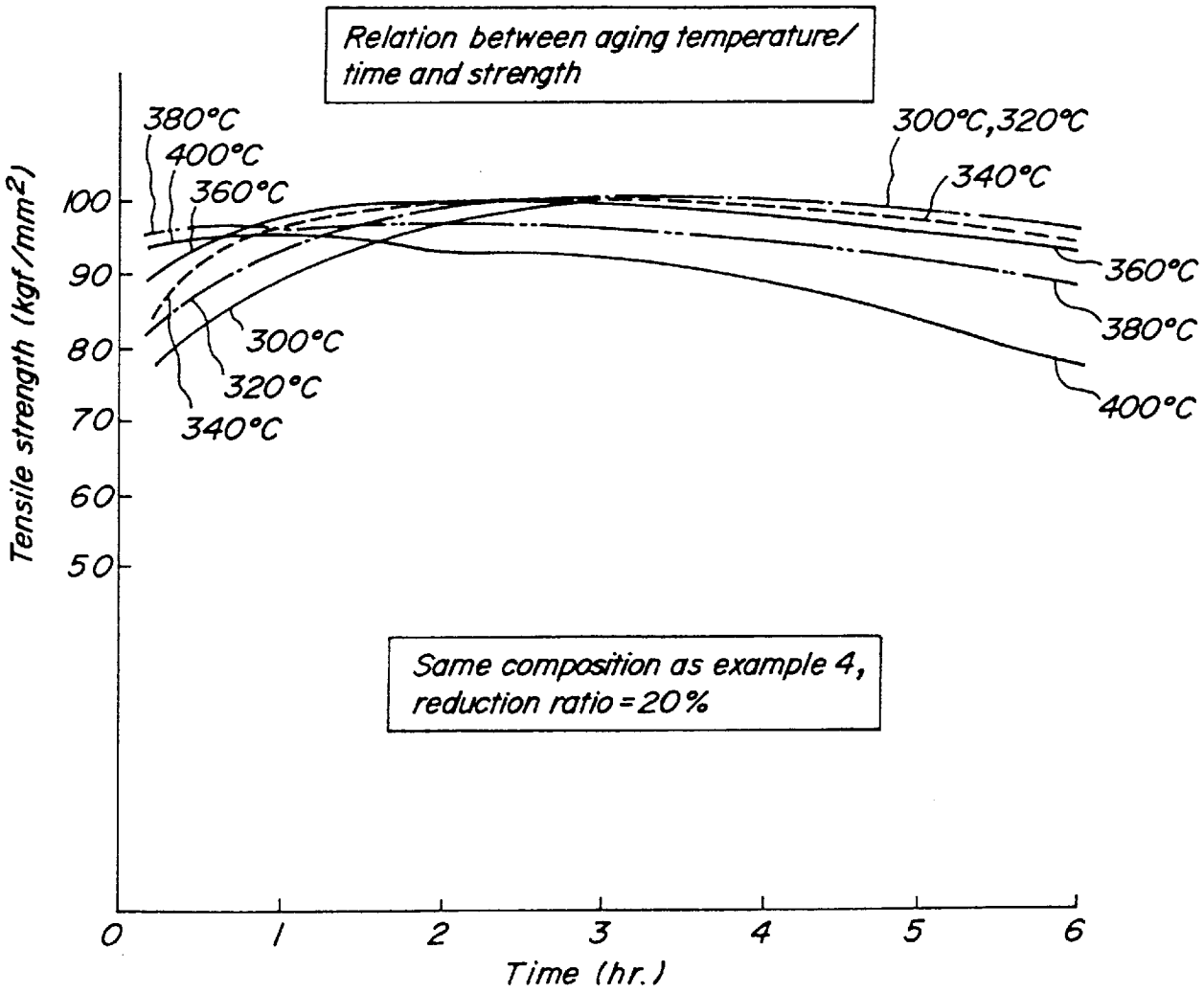
FIG. 1 is a graph showing the relationship between aging treatment time and tensile strength of the obtained product, with an aging treatment temperature as a parameter.

This example relates to mill-hardened materials, in which cast pieces of beryllium-copper alloys having the compositions each shown in Tables 1 to 7 were subjected to solution treatment, finishing working and then aging treatment under the conditions shown in these Tables to prepare products.

The results were examined for stress relaxation ratio, hardness, tensile strength and bending workability of the thus obtained products, and are also shown in Tables 1 to 7 with overall evaluations.

Incidentally, the bending workability was judged visually by subjecting a test specimen having a plate thickness of 0.3 mm to bending working using a bending tool so that the inner bending radius come to 0.3 mm, (R/t ratio=1.0) in accordance with JIS Z 2248, then the bent surface was observed by magnifying it by 30 times. The directions of bending were made parallel direction (0°) and perpendicular direction (90°) to the direction of rolling, and expressed by ◎: not rough, ○: a little rough, Δ: markedly rough, x: cracks, and xx: rupture.

Also, as to data for the amounts of material deformation, small specimens with a size of 20×20 mm were cut from the material having a plate thickness of 0.3 mm in both longitudinal and width directions, and the amounts of curvature were measured before and after heat treatment. For measurement of the amounts of curvature, a non-contact type shape measuring device was used.

Further, as for the heat resistance, among the properties of the materials thus obtained, the stress relaxation ratio (permanent deformation amount) was obtained by the measure using the cantilever beam method at the time of loading the stress of 80% or less of 0.2% proof stress at 200° C. for 100 hours.

TABLE 1

| Mill-hardened materials | Examples | | | | | | |
|---|---|---|---|---|---|---|---|
| Number | 1 | 2 | 3 | 4 | 5 | 6 | 7 |
| Composition wt % | | | | | | | |
| Be | 0.9 | 0.7 | 1 | 0.9 | 1.11 | 1.11 | 1.29 |
| Ni | 0.6 | 0.8 | 0.87 | 0.8 | 0.27 | 0.4 | 0.6 |
| Co | 0 | 0.07 | 0 | 0.07 | 0.6 | 0.47 | 0.27 |
| Al | 0.5 | 1.5 | 1 | 1 | 0.9 | 0.2 | 0.5 |
| Si | 0.3 | 0.8 | 0 | 0 | 0.5 | 1 | 0.5 |
| NiBe + CoBe (theoretical value) | 0.69 | 1.00 | 1.00 | 1.00 | 1.00 | 1.00 | 1.00 |
| NiBe + CoBe (precipitated amount) | 0.39 | 0.82 | 0.54 | 0.52 | 0.57 | 0.60 | 0.67 |
| Ratio of fine particle (%) | 92 | 48 | 62 | 71 | 60 | 58 | 51 |
| Preparation conditions | | | | | | | |
| Solution treatment temperature (°C.) | 910 | 905 | 900 | 910 | 900 | 900 | 885 |
| Cooling temperature* (°C./s) | 45 | 25 | 30 | 35 | 30 | 30 | 25 |
| Aging temperature (°C.) | 340 | 360 | 345 | 350 | 345 | 345 | 340 |
| Aging time (min) | 20 | 80 | 15 | 10 | 15 | 20 | 15 |
| Working ratio (%) | 15 | 20 | 20 | 20 | 20 | 20 | 25 |
| Properties | | | | | | | |
| Stress relaxation ratio (%) | 10 | 12 | 13 | 14 | 15 | 14 | 18 |
| Hardness (Hv) | 241 | 288 | 247 | 245 | 285 | 272 | 276 |
| Tensile strength (kgf/mm$^2$) | 84.5 | 94.6 | 86.7 | 86 | 94.2 | 95.4 | 96.8 |
| Bending workability (0°) | ◎ | Δ | ◎ | ◎ | ○ | ○ | Δ |
| Bending workability (90°) | ◎ | Δ | ◎ | ◎ | ○ | ○ | Δ |

TABLE 1-continued

| Mill-hardened materials | Examples | | | | | | |
|---|---|---|---|---|---|---|---|
| Number | 1 | 2 | 3 | 4 | 5 | 6 | 7 |
| Overall evaluation | very good | good | very good | very good | very good | very good | good |

*Note:
Cooling temperature at the temperature region of 800 to 600° C.

TABLE 2

| Mill-hardened materials | Examples | | | | | | |
|---|---|---|---|---|---|---|---|
| Number | 8 | 9 | 10 | 11 | 12 | 13 | 14 |
| Composition wt % | | | | | | | |
| Be | 1.29 | 0.9 | 0.9 | 1.11 | 1.11 | 0.7 | 0.7 |
| Ni | 0 | 1.05 | 0 | 0.5 | 0.5 | 0.2 | 0.4 |
| Co | 0.87 | 0 | 1.05 | 0.55 | 0.55 | 0.3 | 0.1 |
| Al | 1.5 | 0.5 | 0.8 | 0 | 1 | 2 | 0.5 |
| Si | 0.9 | 1.2 | 0 | 0.6 | 1.1 | 0.2 | 0.9 |
| NiBe + CoBe (theoretical value) | 1.00 | 1.00 | 1.21 | 1.21 | 1.21 | 0.58 | 0.58 |
| NiBe + CoBe (precipitated amount) | 0.65 | 0.79 | 0.72 | 0.72 | 0.77 | 0.41 | 0.40 |
| Ratio of fine particle (%) | 53 | 55 | 61 | 72 | 49 | 60 | 70 |
| Preparation conditions | | | | | | | |
| Solution treatment temperature (°C.) | 890 | 900 | 915 | 905 | 895 | 905 | 910 |
| Cooling temperature* (°C./s) | 25 | 25 | 30 | 35 | 25 | 30 | 35 |
| Aging temperature (°C.) | 340 | 360 | 360 | 350 | 350 | 340 | 340 |
| Aging time (min) | 15 | 15 | 10 | 20 | 30 | 35 | 20 |
| Working ratio (%) | 35 | 30 | 18 | 36 | 25 | 20 | 20 |
| Properties | | | | | | | |
| Stress relaxation ratio (%) | 18 | 14 | 15 | 17 | 13 | 14 | 16 |
| Hardness (Hv) | 290 | 284 | 251 | 255 | 287 | 288 | 251 |
| Tensile strength (kgf/mm$^2$) | 95.9 | 96.6 | 88 | 89.5 | 93.6 | 94.2 | 88.1 |
| Bending workability (0°) | ○ | Δ | ○ | ○ | Δ | ○ | ◎ |
| Bending workability (90°) | Δ | Δ | Δ | ○ | Δ | Δ | ◎ |
| Overall evaluation | good | good | good | good | good | good | good |

*Note:
Cooling temperature at the temperature region of 800 to 600° C.

TABLE 3

| Mill-hardened materials | Examples | | | | | | | |
|---|---|---|---|---|---|---|---|---|
| Number | 15 | 16 | 17 | 18 | 19 | 20 | 21 | 22 |
| Composition wt % | | | | | | | | |
| Be | 0.98 | 0.98 | 1.3 | 0.81 | 1.08 | 1.3 | 0.92 | 1.05 |
| Ni | 0.52 | 0.4 | 0.49 | 0.32 | 0.31 | 0.1 | 0.46 | 0.45 |
| Co | 0 | 0.12 | 0 | 0 | 0 | 0.39 | 0 | 0 |
| Al | 0 | 2.1 | 0 | 2.0 | 2.0 | 2.0 | 1.9 | 1.9 |
| Si | 0.8 | 0.3 | 0.8 | 0 | 0 | 0.3 | 0 | 0 |
| NiBe + CoBe | 0.60 | 0.60 | 0.57 | 0.37 | 0.36 | 0.57 | 0.53 | 0.52 |

TABLE 3-continued

| Mill-hardened materials | Examples | | | | | | | |
|---|---|---|---|---|---|---|---|---|
| Number | 15 | 16 | 17 | 18 | 19 | 20 | 21 | 22 |
| (theoretical value) NiBe + CoBe (precipitated amount) | 0.35 | 0.40 | 0.35 | 0.20 | 0.22 | 0.37 | 0.35 | 0.32 |
| Ratio of fine particle (%) | 91 | 72 | 59 | 62 | 86 | 60 | 81 | 75 |
| Preparation conditions | | | | | | | | |
| Solution treatment temperature (°C.) | 905 | 895 | 890 | 910 | 905 | 880 | 910 | 905 |
| Cooling temperature* (°C./s) | 45 | 35 | 25 | 30 | 45 | 25 | 45 | 40 |
| Aging temperature (°C.) | 340 | 340 | 340 | 340 | 340 | 340 | 340 | 340 |
| Aging time (min) | 15 | 60 | 45 | 20 | 20 | 30 | 20 | 30 |
| Working ratio (%) | 25 | 25 | 20 | 20 | 20 | 20 | 12 | 20 |
| Properties | | | | | | | | |
| Stress relaxation ratio (%) | 9 | 8 | 11 | 10 | 4 | 10 | 8 | 8 |
| Hardness (Hv) | 240 | 290 | 257 | 240 | 259 | 290 | 289 | 291 |
| Tensile strength (kgf/mm$^2$) | 84.2 | 96.9 | 90.2 | 84.2 | 90.4 | 96.3 | 89.9 | 90.0 |
| Bending workability (0°) | ◎ | ○ | ○ | ◎ | ◎ | ○ | ◎ | ◎ |
| Bending workability (90°) | ◎ | Δ | ○ | ○ | ◎ | Δ | ◎ | ○ |
| Overall evaluation | very good | very good | good | good | very good | good | very good | very good |

*Note:
Cooling temperature at the temperature region of 800 to 600° C.

TABLE 4

| Mill-hardened materials | Comparative Examples (Component) | | | | | |
|---|---|---|---|---|---|---|
| Number | 1 | 2 | 3 | 4 | 5 | 6 |
| Composition wt % | | | | | | |
| Be | 0.47 | 0.47 | 0.47 | 0.47 | 1.06 | 1.06 |
| Ni | 2 | 0.97 | 0 | 0.2 | 0.7 | 1 |
| Co | 0.47 | 0.5 | 0.97 | 0.77 | 0.69 | 0.39 |
| Al | 0.2 | 1.5 | 0 | 3 | 3.5 | 0 |
| Si | 0 | 0.5 | 0.5 | 0.6 | 1.5 | 0.1 |
| NiBe + CoBe (theoretical value) | 1.70 | 1.70 | 1.12 | 1.12 | 1.60 | 1.60 |
| NiBe + CoBe (precipitated amount) | 0.78 | 0.50 | 0.25 | 0.75 | 1.15 | 0.75 |
| Ratio of fine particle (%) | 2 | 25 | 7 | 18 | 11 | 4 |
| Preparation conditions | | | | | | |
| Solution treatment temperature (°C.) | 915 | 905 | 915 | 905 | 890 | 905 |
| Cooling temperature* (°C./s) | 1 | 15 | 5 | 10 | 5 | 2 |
| Aging temperature (°C.) | 380 | 380 | 380 | 380 | 360 | 360 |
| Aging time (min) | 30 | 40 | 30 | 30 | 60 | 20 |
| Working ratio (%) | 20 | 20 | 20 | 20 | 20 | 20 |

TABLE 4-continued

| Mill-hardened materials | Comparative Examples (Component) | | | | | |
|---|---|---|---|---|---|---|
| Number | 1 | 2 | 3 | 4 | 5 | 6 |
| Properties | | | | | | |
| Stress relaxation ratio (%) | 21 | 19 | 22 | 26 | 21 | 24 |
| Hardness (Hv) | 148 | 251 | 161 | 266 | 289 | 198 |
| Tensile strength (kgf/mm$^2$) | 51.9 | 88.1 | 56.5 | 89.3 | 89.2 | 69.5 |
| Bending workability (0°) | ○ | X | ◎ | X | XX | Δ |
| Bending workability (90°) | Δ | XX | ○ | XX | XX | X |
| Overall evaluation | Poor strength | Poor workability | Poor strength | Poor workability | Poor workability | Poor strength |

*Note:
Cooling temperature at the temperature region of 800 to 600° C.

TABLE 5

| Mill-hardened material | Comparative Examples (Component) | | | | |
|---|---|---|---|---|---|
| Number | 7 | 8 | 9 | 10 | 11 |
| Composition wt % | | | | | |
| Be | 1.54 | 1.56 | 1.69 | 1.69 | 1.05 |
| Ni | 0.2 | 0.11 | 1.1 | 0 | 0.15 |
| Co | 0.41 | 0.5 | 0.11 | 1.2 | 0 |

TABLE 5-continued

| Mill-hardened material | Comparative Examples (Component) | | | | |
|---|---|---|---|---|---|
| Number | 7 | 8 | 9 | 10 | 11 |
| Al | 0.1 | 1.5 | 0.2 | 0 | 0 |
| Si | 0.3 | 1 | 0 | 0.8 | 0.9 |
| NiBe + CoBe (theoretical value) | 0.70 | 0.70 | 1.40 | 1.40 | 0.17 |
| NiBe + CoBe (precipitated amount) | 0.43 | 0.46 | 1.05 | 1.02 | 0.09 |
| Ratio of fine particle (%) | 40 | 21 | 38 | 12 | 65 |
| Preparation conditions | | | | | |
| Solution treatment temperature (°C.) | 870 | 860 | 865 | 860 | 905 |
| Cooling temperature* (°C./s) | 20 | 10 | 20 | 5 | 30 |
| Aging temperature (°C.) | 340 | 340 | 345 | 345 | 350 |
| Aging time (min) | 40 | 60 | 40 | 15 | 15 |
| Working ratio (%) | 20 | 15 | 20 | 25 | 20 |
| Properties | | | | | |
| Stress relaxation ratio (%) | 20 | 15 | 16 | 14 | 22 |
| Hardness (Hv) | 254 | 290 | 265 | 288 | 201 |
| Tensile strength (kgf/mm$^2$) | 89.1 | 96.8 | 93 | 94.3 | 70.1 |
| Bending workability (0°) | Δ | XX | Δ | X | ⊙ |
| Bending workability (90°) | XX | XX | X | XX | ⊙ |
| Overall evaluation | High cost | Poor work-ability | High cost | Poor work-ability | Poor strength |

*Note:
Cooling temperature at the temperature region of 800 to 600° C.

TABLE 6

| Mill-hardened materials | Comparative Examples (Solution treatment) | | | | | (Aging) | |
|---|---|---|---|---|---|---|---|
| Number | 12 | 13 | 14 | 15 | 16 | 17 | 18 |
| Composition wt % | | | | | | | |
| Be | 1.04 | 1 | 0.9 | 1.29 | 0.7 | 1.04 | 1 |
| Ni | 1 | 0.87 | 0.8 | 0.6 | 0.2 | 1 | 0.87 |
| Co | 0.23 | 0 | 0.07 | 0.27 | 0.3 | 0.23 | 0 |
| Al | 0.6 | 0 | 1 | 0.5 | 2 | 0.6 | 0 |
| Si | 0.3 | 1 | 0 | 0.5 | 0.2 | 0.3 | 1 |
| NiBe + CoBe (theoretical value) | 1.42 | 1.00 | 1.00 | 1.00 | 0.58 | 1.40 | 1.00 |
| NiBe + CoBe (precipitated amount) | 0.95 | 0.85 | 0.61 | 0.58 | 0.41 | 1.15 | 0.85 |
| Ratio of fine particle (%) | 9 | 10 | 14 | 17 | 31 | 6 | 10 |
| Preparation conditions | | | | | | | |
| Solution treatment temperature (°C.) | 845 | 860 | 855 | 860 | 855 | 905 | 900 |
| Cooling temperature (°C./s) | 10 | 5 | 15 | 25 | 2 | 30 | 20 |
| Aging temperature (°C.) | 360 | 350 | 350 | 340 | 340 | 270 | 280 |
| Aging time (min) | 30 | 15 | 10 | 15 | 35 | 120 | 100 |
| Working ratio (%) | 15 | 25 | 25 | 35 | 30 | 25 | 20 |
| Properties | | | | | | | |
| Stress relaxation ratio (%) | 18 | 15 | 16 | 19 | 17 | 17 | 14 |
| Hardness (Hv) | 230 | 249 | 246 | 253 | 235 | 240 | 235 |
| Tensile strength (kgf/mm$^2$) | 81 | 87.2 | 86.5 | 88.9 | 82.6 | 83 | 81.2 |
| Bending workability (0°) | Δ | X | Δ | X | XX | ⊙ | ⊙ |
| Bending workability (90°) | X | X | X | XX | XX | ○ | ⊙ |
| Overall evaluation | Poor work-ability | Poor work-ability | Poor work-ability | Poor work-ability | Poor work-ability | Poor strength | Poor strength |

*Note:
Cooling temperature at the temperature region of 800 to 600° C.

TABLE 7

| Mill-hardened materials | Comparative Examples (Aging) | | | Comparative Examples (Working ratio) | | | | |
|---|---|---|---|---|---|---|---|---|
| Number | 19 | 20 | 21 | 22 | 23 | 24 | 25 | 26 |
| Composition wt % | | | | | | | | |
| Be | 0.9 | 1.29 | 0.7 | 1.04 | 1 | 0.9 | 1.29 | 0.7 |
| Ni | 0.8 | 0.6 | 0.2 | 1 | 0.87 | 0.8 | 0.6 | 0.2 |
| Co | 0.07 | 0.27 | 0.3 | 0.23 | 0 | 0.07 | 0.27 | 0.3 |
| Al | 1 | 0.5 | 2 | 0.6 | 0 | 1 | 0.5 | 2 |
| Si | 0 | 0.5 | 0.2 | 0.3 | 1 | 0 | 0.5 | 0.2 |
| NiBe + CoBe (theoretical value) | 1.00 | 1.00 | 0.58 | 1.42 | 1.00 | 1.00 | 1.00 | 0.58 |
| NiBe + CoBe (precipitated amount) | 0.75 | 0.65 | 0.50 | 0.86 | 0.61 | 0.55 | 0.67 | 0.30 |
| Ratio of fine particle (%) | 13 | 23 | 20 | 19 | 11 | 31 | 49 | 10 |
| Preparation conditions | | | | | | | | |
| Solution treatment temperature (°C.) | 910 | 885 | 905 | 905 | 900 | 910 | 885 | 905 |
| Cooling temperature* (°C./s) | 15 | 10 | 15 | 10 | 5 | 15 | 25 | 5 |
| Aging temperature (°C.) | 420 | 400 | 300 | 360 | 350 | 350 | 340 | 340 |
| Aging time (min) | 5 | 10 | 60 | 20 | 10 | 5 | 8 | 10 |
| Working ratio (%) | 15 | 35 | 20 | 60 | 50 | 60 | 70 | 80 |
| Properties | | | | | | | | |
| Stress relaxation ratio (%) | 14 | 18 | 17 | 15 | 11 | 13 | 16 | 13 |
| Hardness (Hv) | 244 | 273 | 228 | 262 | 251 | 253 | 270 | 270 |
| Tensile strength (kgf/mm$^2$) | 85.5 | 95.1 | 81.5 | 91.3 | 89.2 | 88.5 | 96.1 | 94.5 |
| Bending workability (0°) | Δ | X | ⊙ | X | Δ | X | X | XX |
| Bending workability (90°) | X | XX | ⊙ | X | X | XX | XX | XX |
| Overall evaluation | Poor work-ability | Poor work-ability | Poor strength | Poor work-ability | Poor work-ability | Poor work-ability | Poor work-ability | Poor work-ability |

*Note:
Cooling temperature at the temperature region of 800 to 600° C.

Example 2

This example relates to aging materials, in which cast pieces of beryllium-copper alloys having the compositions each shown in Tables 8 to 12 were subjected to solution treatment, finishing working and then aging treatment under the conditions shown in said Tables to prepare products.

The results were examined for stress relaxation ratio, hardness, tensile strength and banding workability of the thus obtained products, and are also shown in Tables 8 to 12 with overall evaluations.

TABLE 8

| Aging materials | Examples | | | | | | |
|---|---|---|---|---|---|---|---|
| Number | 1 | 2 | 3 | 4 | 5 | 6 | 7 |
| Composition wt % | | | | | | | |
| Be | 0.9 | 0.7 | 1 | 0.9 | 1.11 | 1.11 | 1.29 |
| Ni | 0.6 | 0.8 | 0.87 | 0.8 | 0.27 | 0.4 | 0.6 |
| Co | 0 | 0.07 | 0 | 0.07 | 0.6 | 0.47 | 0.27 |
| Al | 0.5 | 1.5 | 1 | 1 | 0.9 | 0.2 | 0.5 |
| Si | 0.5 | 0.8 | 0 | 0 | 0.5 | 1 | 0.5 |
| NiBe + CoBe (theoretical value) | 0.69 | 1.00 | 1.00 | 1.00 | 1.00 | 1.00 | 1.00 |
| NiBe + CoBe (precipitated amount) | 0.60 | 0.74 | 0.73 | 0.69 | 0.71 | 0.71 | 0.76 |
| Ratio of fine particles (%) | 92 | 48 | 62 | 71 | 59 | 61 | 50 |
| Preparation conditions | | | | | | | |
| Solution treatment temperature (°C.) | 910 | 905 | 900 | 910 | 900 | 900 | 885 |
| Cooling temperature* (°C./s) | 45 | 25 | 30 | 35 | 30 | 30 | 25 |
| Aging temperature (°C.) | 340 | 360 | 345 | 350 | 345 | 345 | 340 |
| Aging time (min) | 300 | 100 | 180 | 120 | 90 | 90 | 120 |
| Working ratio (%) | 15 | 20 | 20 | 20 | 20 | 20 | 25 |
| Properties | | | | | | | |
| Stress relaxation ratio (%) | 7 | 9 | 10 | 12 | 12 | 13 | 16 |

TABLE 8-continued

| Aging materials | Examples | | | | | | |
|---|---|---|---|---|---|---|---|
| Number | 1 | 2 | 3 | 4 | 5 | 6 | 7 |
| Hardness (Hv) | 283 | 330 | 297 | 286 | 325 | 322 | 356 |
| Tensile strength (kgf/mm$^2$) | 99.3 | 110 | 104 | 99.6 | 109 | 109 | 111 |
| Deformation amount ($\mu$m) | 3 | 4 | 5 | 4 | 4 | 4 | 6 |
| Overall evaluation | very good | good | good | very good | very good | very good | good |

*Note:
Cooling temperature at the temperature region of 800 to 600° C.

TABLE 9

| Aging materials | Examples | | | | | | |
|---|---|---|---|---|---|---|---|
| Number | 8 | 9 | 10 | 11 | 12 | 13 | 14 |
| Composition wt % | | | | | | | |
| Be | 1.29 | 0.9 | 0.9 | 1.11 | 1.11 | 0.7 | 0.7 |
| Ni | 0 | 1.05 | 0 | 0.5 | 0.5 | 0.2 | 0.4 |
| Co | 0.87 | 0 | 1.05 | 0.55 | 0.55 | 0.3 | 0.1 |
| Al | 1.5 | 0.5 | 0.8 | 0 | 1 | 2 | 0.5 |
| Si | 0.9 | 1.2 | 0 | 0.6 | 1.1 | 0.2 | 0.9 |
| NiBe + CoBe (theoretical value) | 1.00 | 1.21 | 1.21 | 1.21 | 1.21 | 0.58 | 0.58 |
| NiBe + CoBe (precipitated amount) | 0.65 | 0.88 | 0.69 | 0.72 | 0.89 | 0.51 | 0.46 |
| Ratio of fine particles (%) | 51 | 48 | 61 | 70 | 52 | 63 | 71 |
| Preparation conditions | | | | | | | |
| Solution treatment temperature (°C.) | 890 | 900 | 915 | 905 | 895 | 905 | 910 |
| Cooling temperature* (°C./s) | 25 | 25 | 30 | 35 | 25 | 30 | 35 |
| Aging temperature (°C.) | 340 | 360 | 360 | 350 | 350 | 340 | 340 |
| Aging time (min) | 50 | 120 | 60 | 50 | 180 | 240 | 200 |
| Working ratio (%) | 35 | 30 | 18 | 36 | 25 | 20 | 20 |
| Properties | | | | | | | |
| Stress relaxation ratio (%) | 15 | 12 | 12 | 15 | 11 | 12 | 13 |
| Hardness (Hv) | 340 | 339 | 276 | 283 | 335 | 342 | 300 |
| Tensile strength (kgf/mm$^2$) | 109 | 107 | 96.8 | 99.9 | 111 | 110 | 105 |
| Deformation amount ($\mu$m) | 7 | 5 | 4 | 4 | 5 | 6 | 2 |
| Overall evaluation | good | good | good | good | good | good | good |

*Note:
Cooling temperature at the temperature region of 800 to 600° C.

TABLE 10

| Aging materials | Examples | | | | | | |
|---|---|---|---|---|---|---|---|
| Number | 15 | 16 | 17 | 18 | 19 | 20 | 21 |
| Composition wt % | | | | | | | |
| Be | 0.98 | 0.98 | 1.3 | 0.81 | 1.08 | 0.92 | 1.05 |
| Ni | 0.52 | 0.4 | 0.49 | 0.32 | 0.31 | 0.46 | 0.45 |
| Co | 0 | 0.12 | 0 | 0 | 0 | 0 | 0 |
| Al | 0 | 2.1 | 0 | 2.0 | 2.0 | 1.9 | 1.9 |
| Si | 0.8 | 0.3 | 0.8 | 0 | 0 | 0 | 0 |
| NiBe + CoBe (theoretical value) | 0.60 | 0.60 | 0.57 | 0.37 | 0.36 | 0.53 | 0.52 |

TABLE 10-continued

| Aging materials | Examples | | | | | | |
|---|---|---|---|---|---|---|---|
| Number | 15 | 16 | 17 | 18 | 19 | 20 | 21 |
| NiBe + CoBe (precipitated amount) | 0.41 | 0.41 | 0.39 | 0.31 | 0.30 | 0.41 | 0.40 |
| Ratio of fine particles (%) | 91 | 72 | 51 | 62 | 90 | 89 | 83 |
| Preparation conditions | | | | | | | |
| Solution treatment temperature (°C.) | 905 | 895 | 890 | 910 | 905 | 910 | 905 |
| Cooling temperature* (°C./s) | 45 | 35 | 25 | 30 | 45 | 45 | 40 |
| Aging temperature (°C.) | 340 | 340 | 340 | 340 | 340 | 340 | 340 |
| Aging time (min) | 160 | 50 | 100 | 120 | 120 | 120 | 120 |
| Working ratio (%) | 25 | 25 | 20 | 20 | 20 | 12 | 20 |
| Properties | | | | | | | |
| Stress relaxation ratio (%) | 7 | 5 | 8 | 8 | 4 | 4 | 4 |
| Hardness (Hv) | 275 | 347 | 308 | 300 | 275 | 270 | 275 |
| Tensile strength (kgf/mm$^2$) | 96.5 | 112 | 106 | 104 | 96.0 | 95.9 | 96.4 |
| Deformation amount (μm) | 3 | 3 | 5 | 2 | 3 | 3 | 3 |
| Overall evaluation | very good | very good | good | good | very good | very good | very good |

*Note:
Cooling temperature at the temperature region of 800 to 600° C.

TABLE 11

| Aging materials | Comparative Examples | | | | | |
|---|---|---|---|---|---|---|
| Number | 1 | 2 | 3 | 4 | 5 | 6 |
| Composition wt % | | | | | | |
| Be | 0.47 | 0.47 | 0.47 | 0.47 | 1.06 | 1.06 |
| Ni | 1 | 0.97 | 0 | 0.2 | 0.7 | 1 |
| Co | 0.47 | 0.5 | 0.97 | 0.77 | 0.69 | 0.39 |
| Al | 0.2 | 1.5 | 0 | 3 | 3.5 | 0 |
| Si | 0 | 0.5 | 0.5 | 0.6 | 1.5 | 0.1 |
| NiBe + CoBe (theoretical value) | 1.70 | 1.70 | 1.12 | 1.12 | 1.60 | 1.60 |
| NiBe + CoBe (precipitated amount) | 0.71 | 1.10 | 0.56 | 0.76 | 0.98 | 1.05 |
| Ratio of fine particle (%) | 2 | 29 | 9 | 38 | 10 | 21 |
| Preparation conditions | | | | | | |
| Solution treatment temperature (°C.) | 915 | 905 | 915 | 905 | 890 | 905 |
| Cooling temperature* (°C./s) | 1 | 15 | 5 | 20 | 5 | 10 |
| Aging temperature (°C.) | 380 | 380 | 380 | 380 | 360 | 360 |
| Aging time (min) | 60 | 120 | 100 | 100 | 60 | 300 |
| Working ratio (%) | 20 | 20 | 20 | 20 | 20 | 20 |
| Properties | | | | | | |
| Stress relaxation ratio (%) | 18 | 17 | 21 | 22 | 19 | 21 |

TABLE 11-continued

| Aging materials | Comparative Examples | | | | | |
|---|---|---|---|---|---|---|
| Number | 1 | 2 | 3 | 4 | 5 | 6 |
| Hardness (Hv) | 198 | 269 | 211 | 300 | 276 | 248 |
| Tensile strength (kgf/mm$^2$) | 69.2 | 94.4 | 74 | 99.8 | 97.1 | 87 |
| Deformation amount (μm) | 2 | 4 | 2 | 15 | 17 | 3 |
| Overall evaluation | Poor strength | Poor strength | Poor strength | Excess deformation | Excess deformation | Poor strength |

*Note:
Cooling temperature at the temperature region of 800 to 600° C.

TABLE 12

| Aging materials | Comparative Examples | | | |
|---|---|---|---|---|
| Number | 7 | 8 | 9 | 10 |
| Composition wt % | | | | |
| Be | 1.54 | 1.56 | 1.69 | 1.69 |
| Ni | 0.2 | 0.11 | 1.1 | 0 |
| Co | 0.41 | 0.5 | 0.11 | 1.2 |
| Al | 0.1 | 1.5 | 0.2 | 0 |
| Si | 0.3 | 1 | 0 | 0.8 |
| NiBe + CoBe (theoretical value) | 0.70 | 0.70 | 1.40 | 1.38 |
| NiBe + CoBe (precipitated amount) | 0.47 | 0.50 | 0.97 | 0.91 |
| Ratio of fine particle (%) | 1 | 18 | 4 | 11 |
| Preparation conditions | | | | |
| Solution treatment temperature (°C.) | 870 | 860 | 865 | 860 |
| Cooling temperature (°C./s) | 1 | 10 | 2 | 5 |
| Aging temperature (°C.) | 340 | 340 | 345 | 345 |

TABLE 12-continued

| Aging materials | Comparative Examples | | | |
|---|---|---|---|---|
| Number | 7 | 8 | 9 | 10 |
| Aging time (min) | 90 | 120 | 100 | 60 |
| Working ratio (%) | 20 | 15 | 20 | 25 |
| Properties | | | | |
| Stress relaxation ratio (%) | 18 | 13 | 13 | 13 |
| Hardness (Hv) | 295 | 298 | 301 | 310 |
| Tensile strength (kgf/mm$^2$) | 99.5 | 100 | 102 | 104 |
| Deformation amount ($\mu$m) | 11 | 15 | 18 | 20 |
| Overall evaluation | Excess deformation | Excess deformation | Excess deformation | Excess deformation |

*Note:
Cooling temperature at the temperature region of 800 to 600° C.

Example 3

An alloy cast piece comprising the composition containing 0.8% by weight of Be, 0.8% by weight of Ni, 0.07% by weight of Co and 1.0% by weight of Al, and the balance being substantially Cu was subjected to hot working and then cold working according to conventional method. After solution treatment at 910° C., the cast piece was immediately cooled to room temperature at a rate of 40° C./s. Then, after subjecting the cast piece to finishing working with a working ratio of 20%, aging treatment was carried out with various conditions.

The results of the tensile strength measured with respect to the thus obtained products are shown in FIG. 1.

It can be clearly seen from the figure that, in the present invention, good tensile strength can be obtained with wide aging treatment conditions. Particularly, when it is carried out under preferred conditions at a temperature of 320° to 380° C., extremely excellent tensile strength could be obtained.

INDUSTRIAL APPLICABILITY

The beryllium-copper alloy of the present invention is advantageous in that it has high strength and excellent bending workability, and yet deformation amount at heat treatment is small even though the contents of expensive Be is lowered than conventional products.

Also, the beryllium-copper alloy of the present invention has wide tolerable aging treatment conditions, and as shown in FIG. 1, when it is within the temperature range of 320° to 380° C., even if the aging treatment time is substantially changed in the range of 15 minutes to 6 hours, change in tensile strength can be regulated within the range of ±8 kgf/mm$^2$.

Therefore, the present invention provides advantages that not only an electrically conducting spring material having excellent properties can be realized economically, but also users' burden for aging treatment carried out by themselves can be markedly reduced.

We claim:

1. A beryllium-copper alloy, comprising:

0.5 to 1.5% by weight of Be;

0.3 to 1.5% by weight of at least one member selected from the group consisting of Ni and Co;

0.5 to 2.5% by weight of at least one member selected from the group consisting of Si and Al;

and the balance being substantially Cu;

said alloy containing as an intermetallic compound at least one of NiBe and CoBe in the range of 0.20 to 0.90% by weight, at least 45% thereof being present as fine particles having a diameter of 0.1 $\mu$m or less.

* * * * *